US006250628B1

(12) United States Patent
Klaus

(10) Patent No.: US 6,250,628 B1
(45) Date of Patent: Jun. 26, 2001

(54) ARRANGEMENT FOR DEPOSITING SHEETS OF A RECORDING MEDIUM ONTO A STACK

(75) Inventor: Paulat Klaus, Schoneburg/Schwendi (DE)

(73) Assignee: BDT Buro-und Datentechnik GmbH & Co. KG, Rottweil (DE)

( * ) Notice: Subject to any disclaimer, the term of this patent is extended or adjusted under 35 U.S.C. 154(b) by 0 days.

(21) Appl. No.: 09/405,124

(22) Filed: Sep. 24, 1999

(30) Foreign Application Priority Data

Sep. 26, 1998 (DE) ..... 198 44 231 9

(51) Int. Cl.[7] ..... B65H 31/04
(52) U.S. Cl. ..... 271/218; 271/213
(58) Field of Search ..... 271/213, 218, 271/223, 207, 240, 140

(56) References Cited

U.S. PATENT DOCUMENTS 4,794,859 1/1989 Huseby et al. .

FOREIGN PATENT DOCUMENTS 42 23 344 A1 1/1993 (DE) .
0026655 * 2/1991 (JP) ..... 271/213
7-314813 5/1995 (JP) .
7509635 * 11/1976 (NL) ..... 271/218

* cited by examiner

*Primary Examiner*—H. Grant Skaggs
(74) *Attorney, Agent, or Firm*—Foley & Lardner; Bernard L. Kleinke

(57) ABSTRACT

Sheets are output by an office machine in collected form. The sheets are initially supported on their side edges by rest bars and support levers. The rest bars support the sheets on their side edges while the support levers support the sheets only in their central region. If the rest bars are moved apart, first the front and the rear end of the sheets are released while the central region is still supported by the support levers. Only upon further movement outwardly are the sheets released by the support levers.

9 Claims, 4 Drawing Sheets

ARRANGEMENT FOR DEPOSITING SHEETS OF A RECORDING MEDIUM ONTO A STACK

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The invention relates to an arrangement for depositing sheets of a recording medium. More specifically, the invention relates to arranging stacks of sheets which are output by an office machine.

2. Background

Office machines, such as printers, copiers or the like, typically output sheets of a recording medium, in general sheets of paper, after a recording has been applied to the medium. As a rule, the recording medium, or sheets, are deposited onto a stack. The sheets are frequently output onto the stack, for example, by driven ejection rollers. If an advancing edge of an ejecting sheet contacts another ejecting sheet already on the stack, the ejecting sheet can catch under friction the uppermost already ejected sheet that is loosely lying on the stack and displace the already ejected sheet on the stack. Thereby the orderly deposition of the stack is disturbed.

During the output and deposition of a single sheet the danger is low of an ejecting sheet catching and displacing an uppermost already ejected sheet disposed on the stack. However, if several sheets are output jointly as a collected set, for example the collected sheets of a print job, then, due to the increased weight and the increased friction caused thereby, the danger of unintentional displacement of the uppermost sheet of the stack increases with the number of the sheets output in the collected set.

Therefore, there exists a need for a device to arrange sheets in a stack where the danger of unintentional displacement of the uppermost sheet of the deposited stack is decreased even if several sheets are output and deposited jointly in gathered form or as a collected set.

SUMMARY OF THE INVENTION

An arrangement for depositing sheets in a stack has a first and a second support at both side edges of the sheets. The first support supports the sheets on the sheet's side edges in order to hold the sheets above the stack. The second support supports the sheets only in a central region of the sheet's side edges. When the first support is pulled away laterally, the first support releases the side edges of the sheets, while the second support still supports the central region of the sheets. Therefore, the front and the rear edge of the sheets can move downwardly. Subsequently, the second support is also pulled away laterally from underneath the side edges such that the gathered sheets can altogether fall onto the stack.

Advantageously, the support of the sheets in their central region by the second support ensures that even du ring the lowering of the sheets onto the stack, no shearing forces are transmitted onto the uppermost sheet already disposed on the stack. Even if relatively large print jobs of, for example, up to 100 sheets are output together by the office machine and are deposited in collected form, a displacement of the uppermost sheet of the previously deposited stack is reliably prevented and an orderly deposition over the entire height of the stack is ensured.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

a lateral view of the successive steps during the deposition of the sheets by an arrangement made in accordance with the present invention.

Description of the Best Mode

Figure 1:
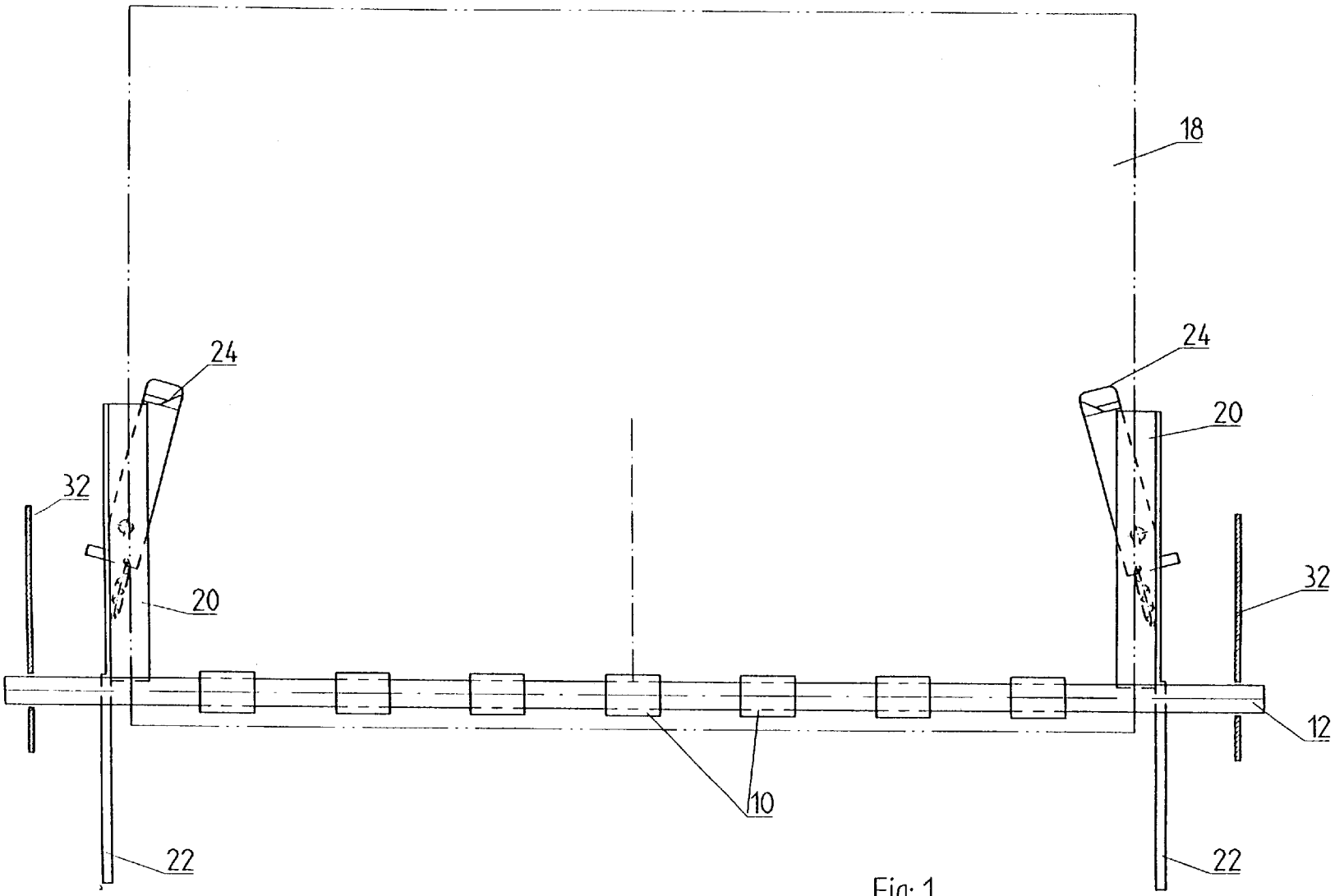
FIG. 1 is a top view of an arrangement made in accordance with the present invention, with the arrangement in the position during the output of the sheets.
Figure 4:
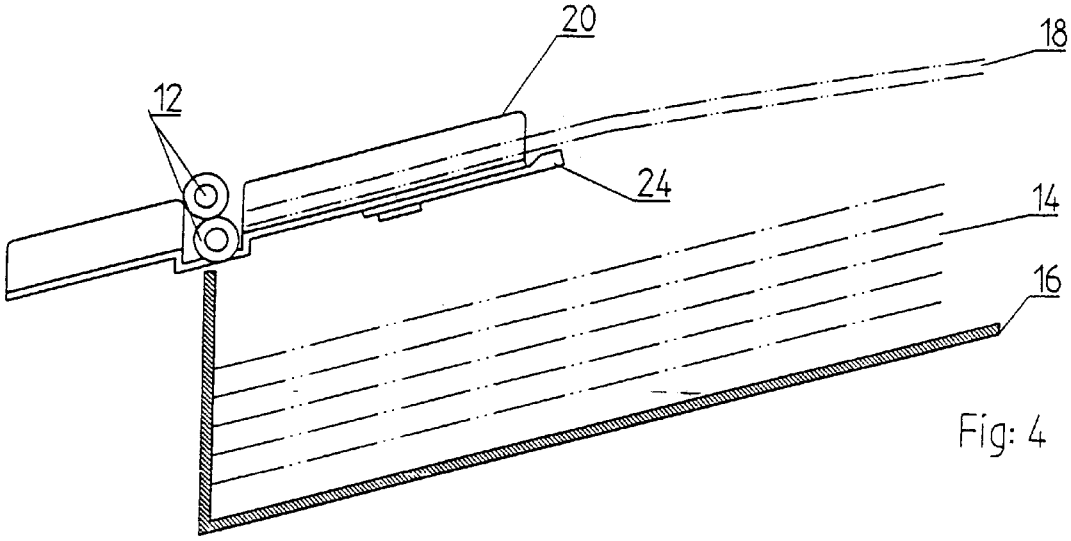
FIGS. 4 to 6 provide (close up)

Referring to FIGS. 1 and 4, an arrangement made in accordance with the present invention is shown. An office machine (not shown), in particular a printer, outputs sheets which are deposited as a stack 14 in a stacking tray 16. The sheets, on which are provided recordings, are deposited via ejection rollers 10 which are disposed on driven ejection shafts 12. In the office machine, the sheets can be collected and output as a collected set 18, for example, of a print job, up to one hundred sheets that are collected after ejection from the ejection rollers 10.

The disclosed embodiment of the present invention comprises depositing the sheets output by the office machine not directly onto the already deposited stack but rather to support the deposited sheets initially on their side edges above the stack. The sheets are supported and held above the stack until they are output completely and no depositing force is acting on the sheets. Subsequently, the support means supporting the sheets on their side edges are moved away toward the side such that the sheets are allowed to be placed onto the stack from above.

The ejection rollers 10 are disposed above the stacking tray 16 such that the collected set 18 of sheets exits at a distance above the stack 14. The ejection rollers 10 are succeeded on both sides by first support means which are each implemented as a rest bar 20. The rest bars 20 extend in the direction of the output of the collected set 18 and the rest bars 20 mutual spacing can be adjusted according to the paper format of the output sheets. The two rest bars 20 are each connected with a stay 22 and by means of this stay are laterally displaceable, i.e. in the direction of the axis of the ejection shaft 12. The stays 22 are moved via a suitable drive (not shown) and preferably serve to provide a common offset displacement for the output collected set 18.

The rest bars 20 are placed adjacent to the exit gap of the ejection rollers 10 and are positioned in the direction of output of the collected set 18, and in this direction have a length which corresponds approximately to one half of the length of the sheets.

Figure 2:
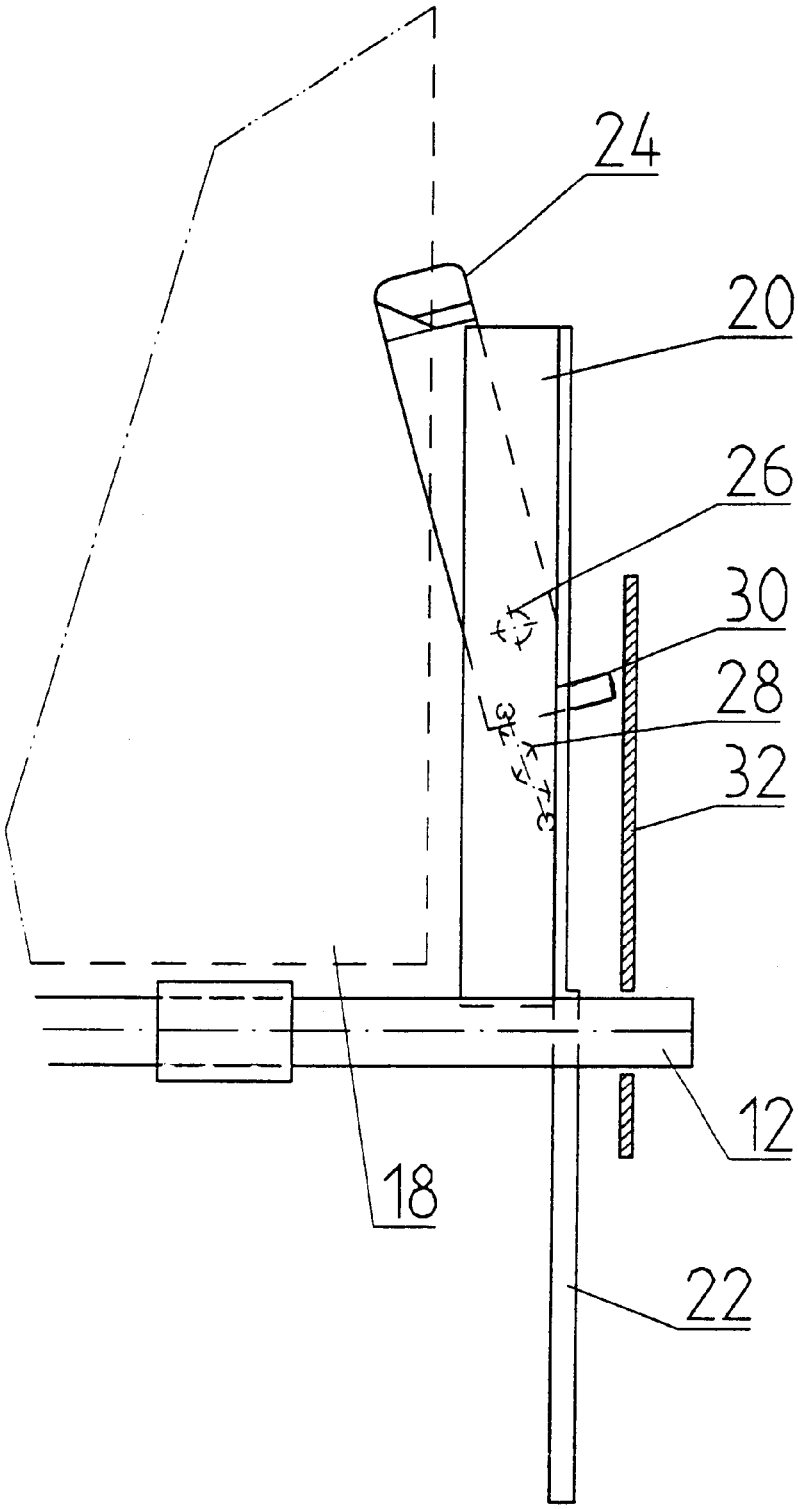
FIG. 2 is an enlarged partial depiction of the arrangement of FIG. 1 after the first support means have been moved away.

On each of the rest bars 20 are supported a second support means in the form of support levers 24. The second support means is supported pivotably about a vertical axis 26. As shown in FIG. 2, a tension spring 28 engages the support lever 24 with its one end and the rest bars 20 with its other end. The tension spring 28 pivots the support lever 24 into a position in which the support lever 24 projects inwardly over the rest bars 20 and thereby under the collected set 18. The support lever 24 is dimensioned and disposed with its pivot axis 26 on the rest bars 20 such the support lever 24 has a free end projecting inwardly and is located in a central longitudinal region of the collected set 18.

Figure 3:
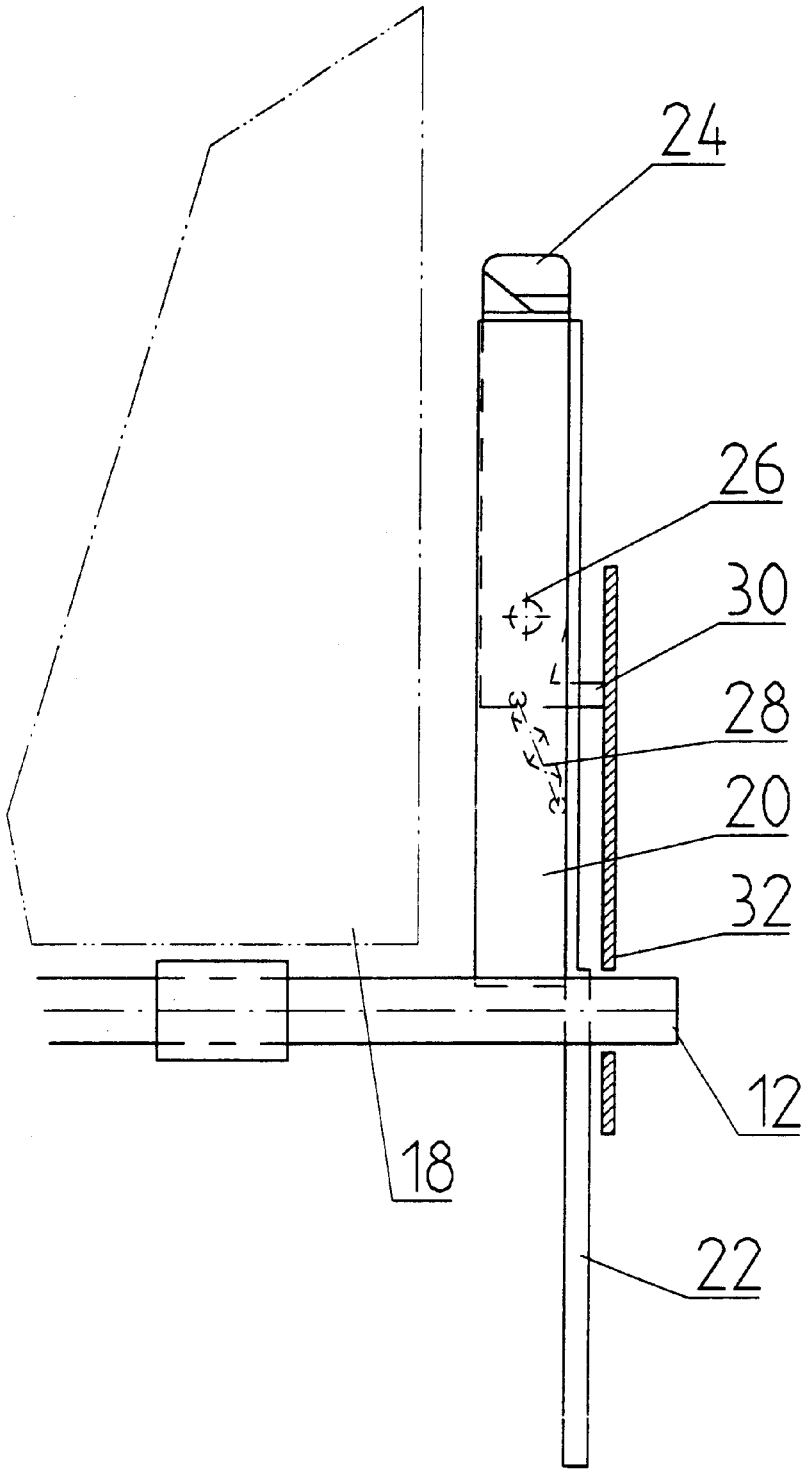
FIG. 3 is a depiction corresponding to FIG. 2 after the second support means have been moved away.

A projection 30 is formed on the support lever 24 and positioned at the end of the support lever 24 opposing the free supports end. If the rest bars 20 are moved away laterally, i.e. moved apart, the projection 30 makes contact with a wall 32, which is stationary on the case. As shown in FIG. 3, as the rest bars 20 are moved, the support lever 24 is thereby pivoted against the action of the tension spring 28 such that its free end moves outwardly and the support lever 24 is substantially congruent with the rest bars 20.

The operation of the will now be discussed while referring to FIGS. 1–6:

First, the two rest bars 20 are moved toward one another such that the inside spacing between them is less than the width of the format of the output paper. The support levers 24 are each pivoted and positioned inwardly by the tension spring 28. The arrangement thus assumes the position as shown in FIG. 1. In this position the collected set 18 of sheets, for example a print job, is output by the ejection rollers 10. As shown in FIGS. 1 and 4, the collected set 18 is supported on its two side edges by the rest bars 20 as well as also by the free ends of the support levers 24. When the collected set 18 is output completely and its trailing edge is released completely by the ejection rollers 10, the collected set 18 is held above the already deposited stack 14 by the rest bars 20 and the support levers 24 as is shown in FIG. 4.

Figure 5:
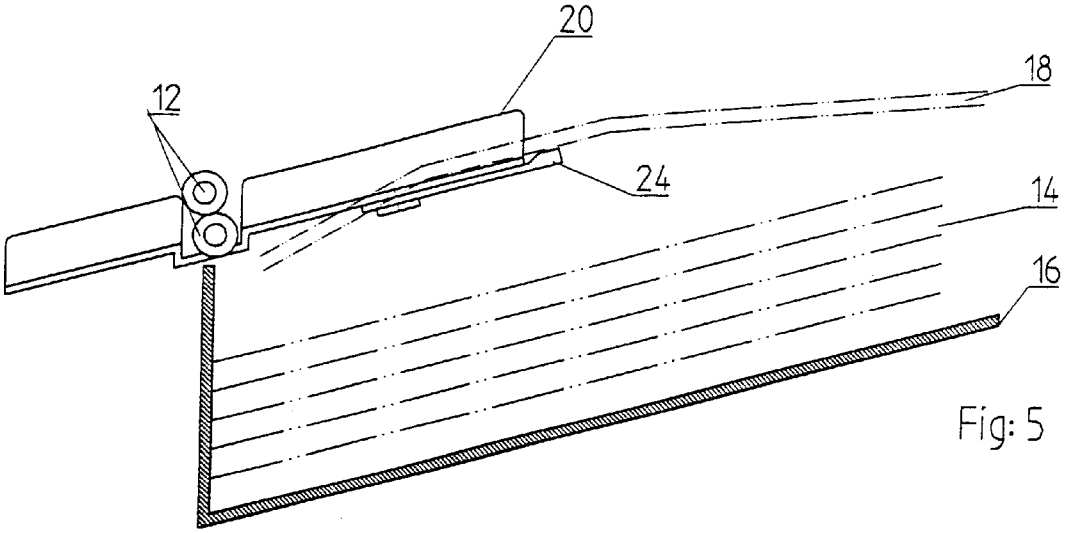

When the collected set 18 has exited completely the ejection rollers 10, the rest bars 20 are laterally moved away, i.e. moved apart, by means of the stays 22. Initially the rest bars 20 are pulled away to the side from underneath the side edges of the superjacent collected set 18. In this condition, as shown in FIGS. 2 and 5, the side edges of the collected set 18 are no longer supported by the rest bars 20, but are still disposed on the free ends of the inwardly pivoted support levers 24. The front edge and the trailing rear edge of the collected set 18 can thus already drop downwardly while the central region of the collected set 18 is still supported by the support levers 24.

Figure 6:
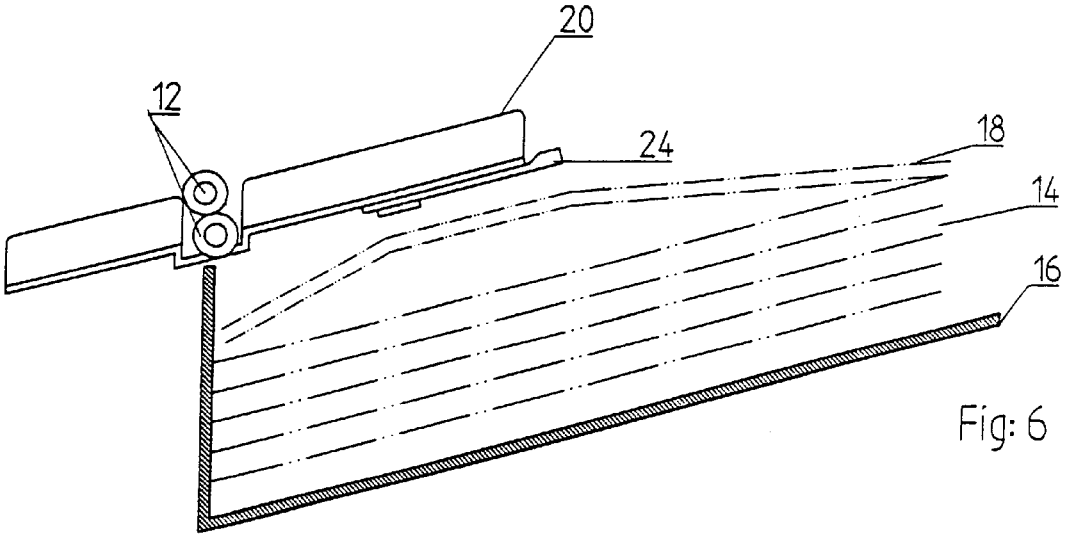

During the further outward movement of the rest bars 20, the projection 30 on the support levers 24 come to stop at the wall 32. The rest bars are thereby pivoted outwardly against the force of the tension spring 28 into the position generally shown in FIG. 3. This also causes the support. levers 24 to be pulled away outwardly from underneath the side edges of the collected set 18. In such a manner the collected set 18 is completely released and can fall gently downwardly onto the already deposited stack 14, as is shown in FIG. 6. During the fall of the collected set 18 onto the stack 14, the collected set 18 has no movement component in the plane of the uppermost sheet of stack 14. Thereby there is no danger that the uppermost sheet disposed on the stack 14 is shifted by the deposited collected set 18.

Finally, the rest bars 20 are subsequently again moved toward one another in order to bring the arrangement again into the position shown in FIG. 1 to receive the output of a next collected set 18.

A constructionally simple structuring is obtained if the first support is implemented as rest bars onto which the output sheets are deposited. The lateral moving-away sequentially in time of the first and the second support means can be realized in simple manner such that the second supports are disposed on the first support means and are moved together with them. For example, the second support can be supported as a support lever on the first support means.

In order to keep the space requirement of the arrangement as low as possible, the second supports are preferably implemented as support levers which are pivotably disposed on the first support. Thereby space for the lateral displacement movement of the first support is required only while the moving displacement for pulling away the second support is caused by its pivot movement.

In an especially simple embodiment the pivotable support levers are pivoted under spring tension into their supporting position and, during the lateral movement of the first support means, are pivoted by a stop against the spring force out of their supporting position.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An arrangement for depositing onto a stack sheets of a recording medium which are output by an office machine, comprising:

first support means positioned above the stack for supporting the output sheets on their two side edges extending in the direction of output;

second support means for supporting the output sheets only in a central region of the side edges;

wherein the first support means and the second support means are movable such that the first support means are pulled laterally away from the side edges of the sheets and, after a time delay, the second support means are pulled laterally away from the side edges of the sheets in order to deposit the sheets on the stack.

2. The arrangement for depositing according to claim 1, wherein the second support means are positioned on the first support means and are moved with them.

3. The arrangement for depositing according to claim 1 wherein the first support means comprise rest bars, with each rest bar each extending in the direction of the side edges.

4. The arrangement for depositing according to claim 1, wherein the second support means further includes support levers, with each support lever extending under the side edges.

5. An arrangement for depositing onto a stack sheets of a recording medium which are output bv an office machine, comprising:

first support means positioned above the stack for supporting the output sheets on their two side edges extending in the direction of output;

second support means for supporting the output sheets only in a central region of the side edges;

wherein the first support means and the second support means are movable such that the first support means are pulled laterally away from the side edges of the sheets and, after a time delay, the second support means are pulled laterally away from the side edges of the sheets in order to deposit the sheets on the stack;

wherein the second support means further includes support levers, with each support lever extending under the side edges; and wherein the support levers (24) are supported pivotably about a vertical axis (26) on corresponding rest bars (20) and are pivotable between a position extending inwardly above the rest bars (20) and a position substantially congruent with the rest bars (20).

6. Arrangement as claimed in claim 5, characterized in that the support levers (24) are prestressed by a spring force (28) into their inwardly pivoted support position and are pivoted against, this spring force (28) from this support position into the release position congruent with the rest bars (20).

7. Arrangement as claimed in claim 6, characterized in that the support levers (24) are moved against a stop when the rest bars (20) are moved outwardly, and are pivoted by this stop (32) against the spring force (28).

8. A device for depositing sheets onto a stack, comprising:

at least two rest bars extending in an output direction, each of said rest bars being configured to support the sheets along at least a portion of an edge; and at least two support levers, each of said levers extending from one of said rest bars and being configured to support the sheets at only a central region of said edge.

9. The device recited in claim 8, wherein said rest bars are configured to be moved from a supporting position to a non-supporting position, thereby leaving the support levers supporting the sheets at only the central region.

* * * * *

UNITED STATES PATENT AND TRADEMARK OFFICE

CERTIFICATE OF CORRECTION

PATENT NO. : 6,250,628 B1
DATED : June 26, 2001
INVENTOR(S) : Paulat, Klaus

It is certified that error appears in the above-identified patent and that said Letters Patent is hereby corrected as shown below:

Title page,
Item [75], Inventors name should read as, -- Klaus Paulat --.

Column 5,
Line 16, should not have a comma after the word "against"
Line 18, "bars." should be -- bar. --

Signed and Sealed this

Eleventh Day of June, 2002

*Attest:*

*Attesting Officer*

JAMES E. ROGAN
*Director of the United States Patent and Trademark Office*